US006112377A

United States Patent [19]

Wilson

[11] Patent Number: 6,112,377

[45] Date of Patent: Sep. 5, 2000

[54] MULTIPLE ARTICLE FASTENING DEVICE

[76] Inventor: Eric P. Wilson, 259 Center St., W., Warren, Ohio 44481

[21] Appl. No.: 09/419,999

[22] Filed: Oct. 18, 1999

[51] Int. Cl.[7] ..... A47H 3/00; B21F 27/00

[52] U.S. Cl. ..... 24/452; 24/306; 160/237

[58] Field of Search ..... 24/306, 442, 452; 245/1, 2; 160/236, 237, 382, 327, 180, 178.1

[56] References Cited

U.S. PATENT DOCUMENTS

| | | | |
|---|---|---|---|
| 3,192,589 | 7/1965 | Pearson . | |
| 4,222,162 | 9/1980 | Levy et al. | 245/1 X |
| 4,290,174 | 9/1981 | Kalleberg . | |
| 4,760,980 | 8/1988 | Sharpe | 160/237 X |
| 5,077,870 | 1/1992 | Melbye et al. . | |
| 5,819,391 | 10/1998 | Matsushima et al. | 24/452 |
| 5,845,375 | 12/1998 | Miller et al. . | |
| 6,027,079 | 2/2000 | Santoro | 24/306 X |

OTHER PUBLICATIONS

New York Wire, Product Brochure, 1997, 8 pages.

*Primary Examiner*—Anthony Knight
*Assistant Examiner*—Robert J. Sandy
*Attorney, Agent, or Firm*—Robert J. Herberger

[57] ABSTRACT

A fastening device comprising a pair of attachment pads, each pad having at least two faces with one face having a plurality of mushroom-shaped interlocking members. The interlocking members are uniformly spaced so that the mushroom-shaped members of one attachment pad interlock with the mushroom-shaped members of the opposing attachment pad. A screen material has a mesh corresponding substantially with the spaced relationship of the mushroom-shaped interlocking members of the pair of attachment pads. The screen material is securely engaged by the mushroom-shaped interlocking members of the attachment pads.

20 Claims, 4 Drawing Sheets

MULTIPLE ARTICLE FASTENING DEVICE

FIELD OF THE INVENTION

This invention relates to a fastening device having a screen engaged through mushroom-shaped interlocking members of opposing attachment pads. More specifically, the invention is used for securing multiple components in various applications using screen material.

BACKGROUND OF THE INVENTION

Fasteners are used in a variety of applications, including construction, machinery, medical equipment, business activities and the textile industry. Commonly known fasteners range from rivets, snaps and buttons to VELCRO® (a registered trademark of Velcro USA, Inc.), and they usually involve a two piece assembly for joining two articles together. Furthermore, fasteners such as rivets and snaps employ a male and female component. More technologically advanced two piece fasteners such as VELCRO® and DUAL-LOCK™, are composed of interlocking members instead of male and female components. DUAL-LOCK™ as shown in FIG. 1 is a trademark of Minnesota Mining and Manufacturing Company. In these assemblies, each component of the two piece fastener is attached to the outside of its respective article, joining the two articles together when the components are mated.

While these types of fasteners perform satisfactorily in their respective applications, they are deficient in other applications. For example, fasteners which are secured to articles through an adhesive backing only fail if lint accumulates on the adhesive. Further, sewn on fasteners can fall off the article when thread breaks or becomes unstitched. Analogous problems occur in screen applications, particularly when securing screens in windows. Problems occur when part of the screen fastener detaches from the screen itself due to repeated use. These types of common fasteners are also very cumbersome to use. It can also be burdensome when trying to obtain a secure fit between the screen and the window frame. Of course screens have many other applications, such as covering structural openings like garages, and the problems with the screen fasteners still remain.

Such common fasteners also present problems when a screen needs to be covered with another material such as clear plastic or nylon to protect against inclement weather or very small insects. In order to cover the screen, separate fastening units are needed to secure the covering material in place.

As previously stated, art in the field is directed to a variety of fasteners. However, none of the fasteners presently known solve the aforementioned problems regarding screen placement. The preferred invention would engage a screen between at least two interlocking attachment pads to result in easier, quicker and more flexible installation which is more firmly secured thereto, not to mention easier cleaning and maintenance. The preferred invention would also have the capability of securing multiple layers of screens within one fastening device. This way plastic, nylon or other desired material can be edged with a screen-like material and then engaged between the attachment pads along with the screen so the engaged screen can be covered when desired. For the foregoing reasons, there is a need for a fastening device that incorporates a single screen or multiple screens between interlocking components.

SUMMARY OF THE INVENTION

The present invention is directed to a fastening device that satisfies the need for securing a single screen or multiple screens between interlocking components. The device comprises a pair of attachment pads, each pad having at least two faces with one face having a plurality of mushroom-shaped interlocking members. The interlocking members are uniformly spaced so that the mushroom-shaped members of one attachment pad interlock with the mushroom-shaped members of the opposing attachment pad. A screen material having a mesh, corresponding substantially with the spaced relationship of the mushroom-shaped interlocking members of the pair of attachment pads, is securely engaged by the interlocking members of the pair of attachment pads. Another embodiment of the invention comprises an inner attachment pad with a plurality of mushroom-shaped interlocking members on both faces of the inner attachment pad.

Accordingly, it is an object of the present invention to provide a fastening device that securely engages one screen or a multiple of screens between two opposing attachment pads having a plurality of interlocking mushroom-shaped members.

Still another objective of the present invention is to provide a fastening device that engages a screen and a screen-edged second material between the opposing attachment pads so that the second material can either be rolled up to allow ventilation through the screen or unrolled to provide privacy or protect against inclement weather and insects.

Yet, another object of the present invention is to provide a fastening device that is easy to use, versatile and economical, providing firm fastening.

Also, another object of the present invention is to provide a fastening device that allows for mending torn screens or joining multiple screens together (edge to edge).

Further, another objective of the present invention is to provide a fastening device that is removable and reusable to allow easy cleaning and maintenance of the screen.

These and other features, aspects and advantages of the present invention will become understood with reference to the following description and appended claims.

BRIEF DESCRIPTION OF THE DRAWINGS

The figures listed below have been selected to illustrate a preferred embodiment of the present invention. These figures along with the accompanying description are sufficient for those skilled in the art to practice the invention as claimed.

PREFERRED EMBODIMENT

Figure 1:
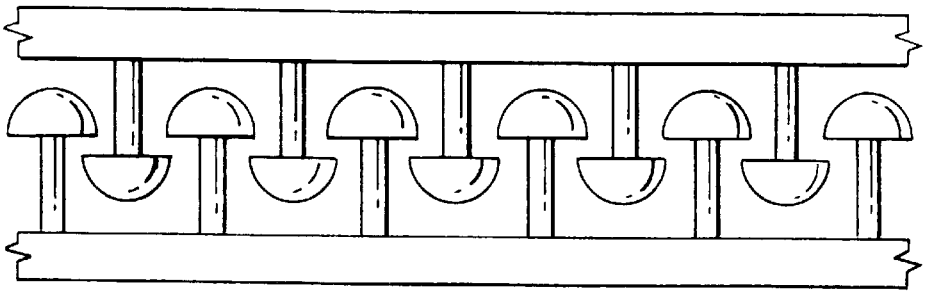
FIG. 1 PRIOR ART
FIG. 1 is a partial end view of the art showing a two-piece item.
Figure 2:
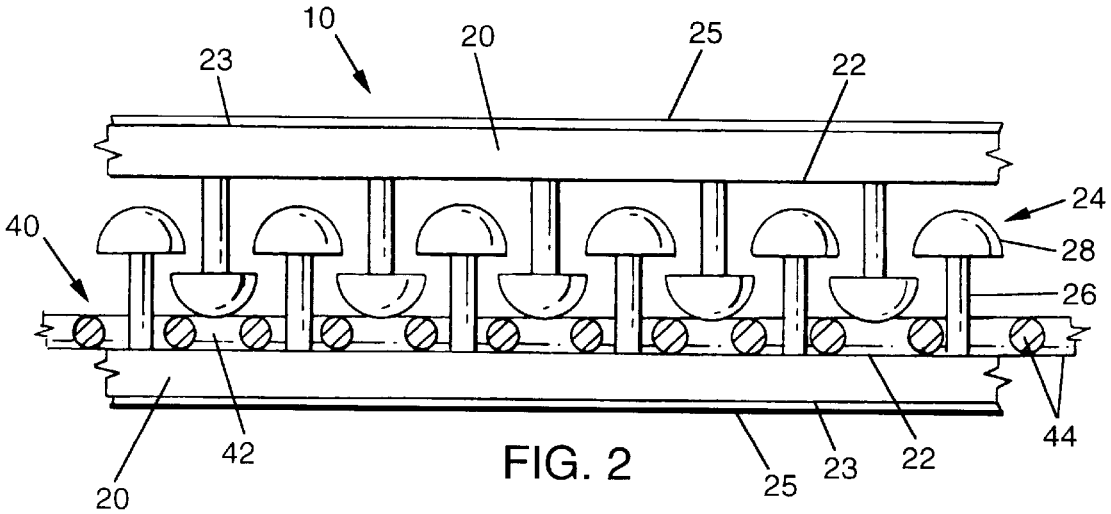
FIG. 2 is a partial end view illustrating the invention with three components.

Viewing FIG. 2, a fastening device 10 comprises two outer attachment pads 20 and a screen material 40. Each outer attachment pad 20 has at least two faces 22, 23 which comprise an outside attachment face 23 and an interlocking face 22. The interlocking face 22 includes a plurality of mushroom-shaped interlocking members 24 that are comprised of a stem 26 and a cup 28. The screen material 40 has a mesh 42 corresponding substantially with the spaced relationship of the mushroom-shaped interlocking members 24 of the outer attachment pads 20.

The mesh 42 of the screen material 40 represents the number of openings per inch, and the mesh 42 has a rectangular or square weave 44 (openings). The optimum mesh size is 18×14, which indicates eighteen openings across and fourteen openings down per each square inch of screen material 40. Also, referring to the DUAL LOCK™ fasteners, the preferred attachment pad size is the self-engaging type 250 stem pattern that comprises approximately 250 mushroom-shaped interlocking members 24 per square inch. More specifically, the type 250 stem pattern fastener includes model numbers SJ-3460, SJ-3560, SJ-3440, SJ-3540 and SJ-3550, as provided by Minnesota Mining and Manufacturing Company. Of course other mesh and attachment pad sizes can be used provided that the weave 44 substantially corresponds with the spaced relationship of the mushroom-shaped interlocking members 24 of the outer attachment pads 20. The screen material 40 can be a rigid material such as metal, or it can be a flexible material such as plastic, but it is not limited thereto.

The fastening device 10 is utilized by positioning the screen material 40 between the opposing outer attachment pads 20. When pressure is applied to the outside attachment face 23 of both opposing outer attachment pads 20, the screen material 40 is engaged via the mushroom-shaped interlocking members 24 passing through the mesh 42 of the screen material 40. Because the cross-sectional area of the cap 28 is less than the cross-sectional area of the rectangles of the weave 44 in the mesh 42, the mushroom-shaped interlocking members 24 of each outer attachment pad 20 can pass through the mesh 42 to engage the screen material 40. Once the screen material 40 is engaged between the outer attachment pads 20, the fastening device 10 can be positioned on any structure at a desired location. The fastening device 10 can be attached through any feasible means such as with clips, staples or nails. Alternatively, the outside attachment face 23 could also be coated with a sticky adhesive 25, which would bond with an appropriate surface in order to position the fastening device 10.

Figure 3:
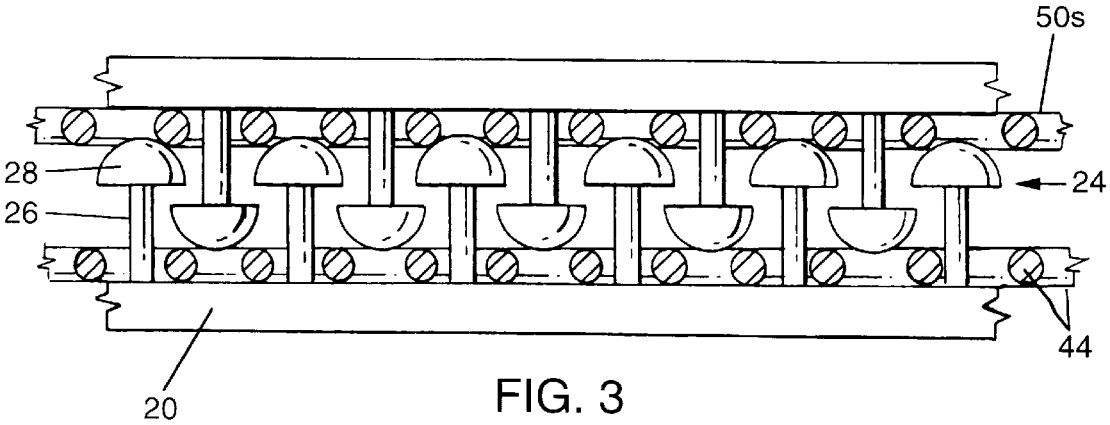
FIG. 3 is a partial end view showing the invention with four components.
Figure 4:
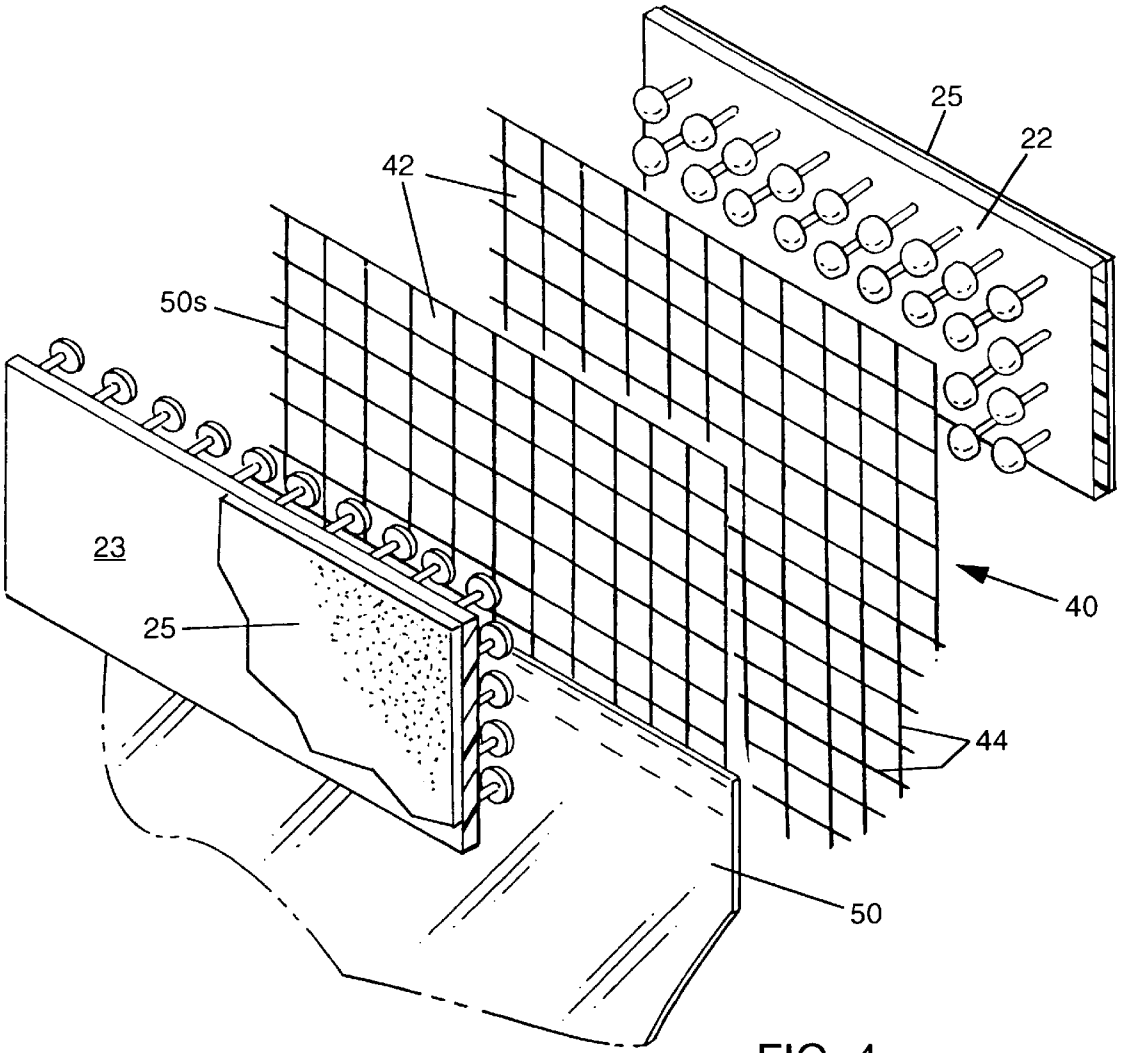
FIG. 4 is an exploded perspective view depicting a four-component device with the screen and a screen-edged second material as plastic or canvas.
Figure 5:
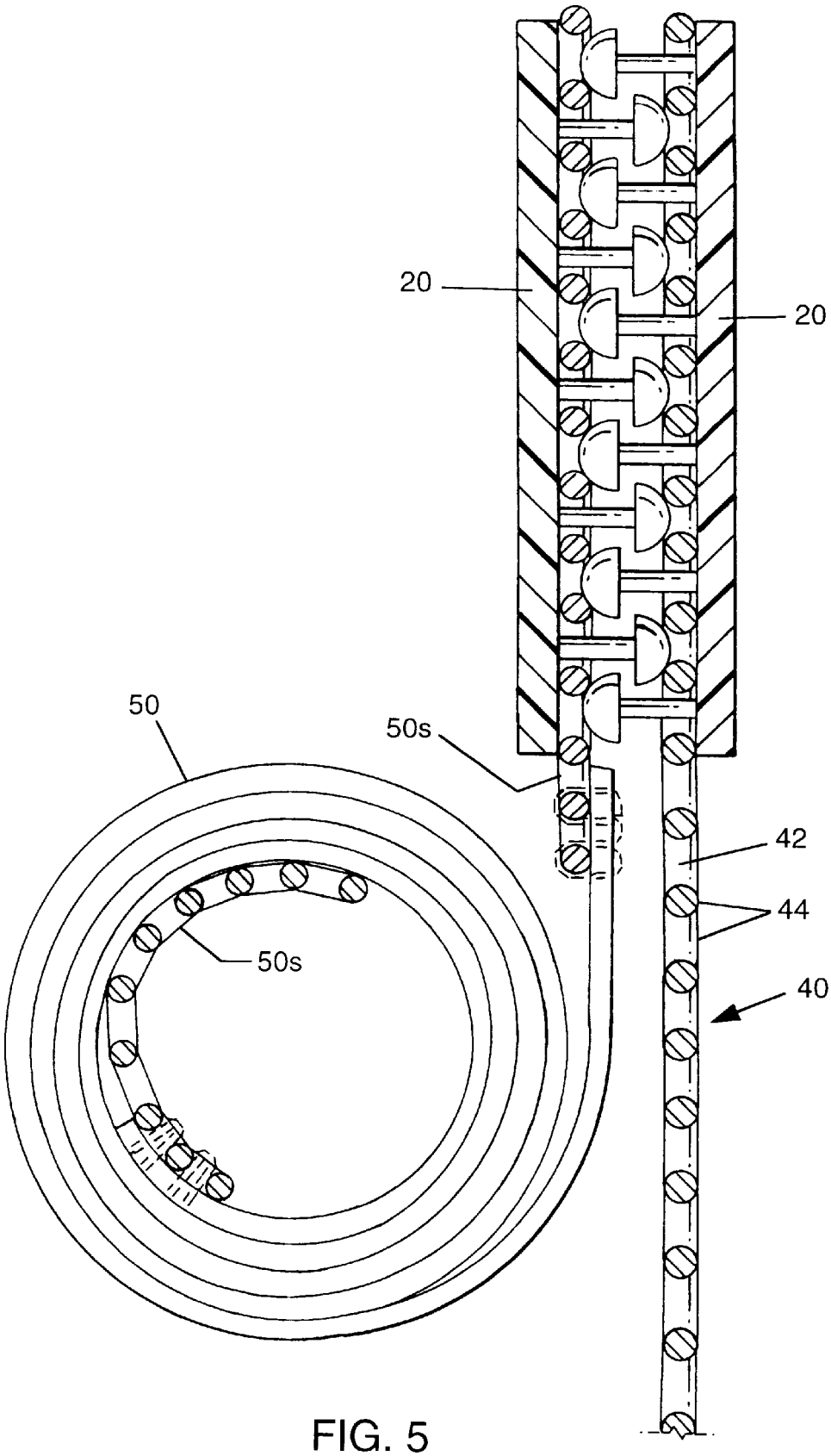
FIG. 5 is an end view showing FIG. 4 with a screen on the inside and a rolled up canvas/clear plastic on the outside.

In another embodiment of the invention as shown in FIGS. 3 and 4, two pieces of screen material 40 arc simultaneously engaged between the opposing outer attachment pads 20. A second material 50, such as clear plastic or canvas, but not limited thereto, has screen material 50*s* securely attached at its outer perimeter. The screen 50*s* of the second material 50 is positioned between the outer attachment pads 20 along with the original screen material 40. The second material 50 allows for the original screen material 40 to be covered to provide privacy, to protect against inclement weather or to prevent small insects from penetrating the screen material 40. If it is not desired for the screen-edged second material 50 to cover the screen material 40, the second material 50 can be rolled-up out of position as shown in FIG. 5. Alternatively, the opposing outer attachment pads 20 can be easily removed by pulling apart and disengaging the screen-edged second material 50, and subsequently refastened by pushing them back together to re-engage the original screen material 40.

Figure 6:
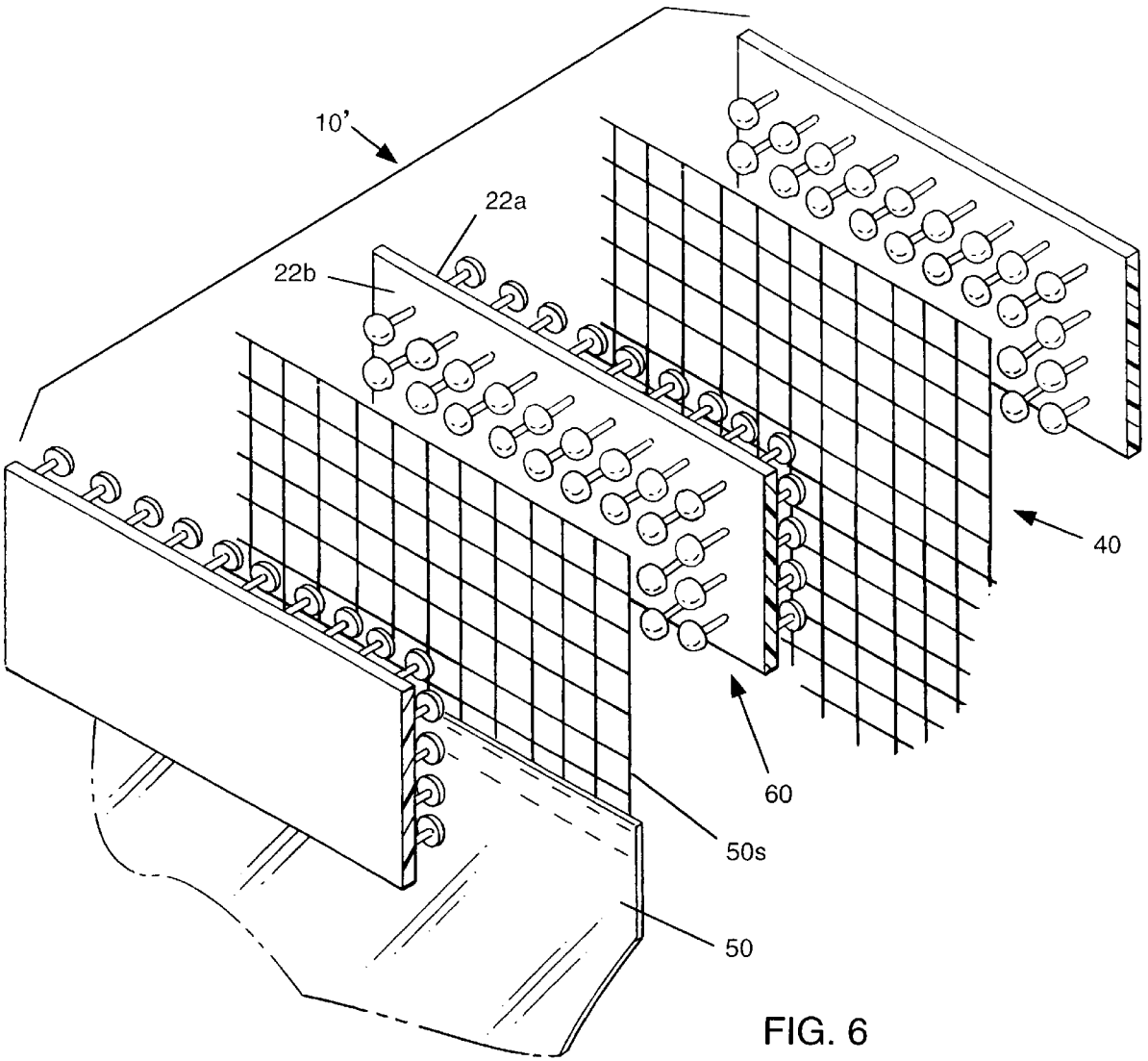
FIG. 6 is another embodiment showing an exploded perspective view of a five-component device with an additional inner attachment pad that has the mushroom-shaped interlocking members on both faces.

FIG. 6 illustrates a third embodiment of the invention, wherein an inner attachment pad 60 is positioned between the opposing outer attachment pads 20. The inner attachment pad 60 has two interlocking faces 22*a* and 22*b*, which have the same mushroom-shaped interlocking members 24 as the outer attachment pads 20. When multiple components of screen material 40 are engaged in the fastening device 10', it is preferred that the screen material 40 be positioned between one outer attachment pad 20 and the interlocking face 22*a* of the inner attachment pad 60, and the screen-edged second material 50 be engaged between the opposing outer attachment pad 20 and the other interlocking face 22*b* of the inner attachment pad 60.

The previously described versions of the present invention have many advantages, including easier and more secure positioning of screens in openings, such as windows, and less burdensome maintenance and cleaning of the screen. Also, multiple screens can be joined together by the fastening device so that the covering can be enlarged to accommodate different sized openings. Multiple screens can be used simultaneously by the fastening device so that the original screen can be covered to prevent inclement weather from entering a structure, to prevent very small insects from infiltrating the screened in area or to provide privacy. The invention is very easy to use, versatile, reusable, reclosable and economical.

Although the present invention has been described in considerable detail with reference to certain preferred versions thereof, other versions are possible. Therefore, the spirit and scope of the appended claims should not be limited to the description of the preferred versions contained herein.

What is claimed is:

1. A fastening device comprising:

a pair of attachment pads, each pad having at least two faces with one face having a plurality of mushroom-shaped interlocking members, each mushroom-shaped interlocking member comprising a stem and a cap the interlocking members being uniformly spaced so that the mushroom-shaped members interlock with the mushroom-shaped members of the opposing attachment pad;

a screen material having a mesh comprising a rectangular or square shaped weave the weave of the screen material corresponding substantially with the spaced relationship of the mushroom-shaped interlocking members of the pair of attachment pads; and the screen material being securely engaged between the pair of attachment pads by interlocking the members that pass through the mesh of the screen material and the stem of each mushroom-shaped interlocking member passing through the weave of the screen material having a length long enough to accommodate the thickness of the screen and height of the interlocking cap of the opposing attachment pad.

2. The fastening device of claim 1, wherein the cap of each interlocking member passing through the weave of the screen material having a cross-sectional area being less than the area of each shape of the woven mesh so that said cap can pass through a corresponding shape of the woven mesh and interlock with interlocking members of the opposing attachment pad.

3. A fastening devices comprising:

a pair of attachment pads each pad having at least two faces with one face having a plurality of mushroom-shaped interlocking members the interlocking members being uniformly spaced so that the mushroom-shaped members interlock with the mushroom-shaped members of the opposing attachment pad;

a screen material having a mesh corresponding substantially with the spaced relationship of the mushroom-shaped interlocking members of the pair of attachment pads;

the screen material being securely engaged by the interlocking members of the pair of attachment pads; and a second material having a screened-edge, the screened-edge being securely engaged by the interlocking members of the pair of attachment pads simultaneously with the screen material.

4. The fastening device of claim 3, wherein the second material is plastic.

5. The fastening device of claim 3, wherein the second material is canvas.

6. A fastening device, comprising:

two opposing attachment pads, each pad having two faces with a plurality of mushroom-shaped interlocking members on one face, each mushroom-shaped interlocking member comprising a stem and a cap, the interlocking members being uniformly spaced with the interlocking members of the opposing attachment pad; and a screen having a thickness engaged between the two interlocking attachment pads by interlocking the members passing through a mesh of the screen the mesh comprising a rectangular or square shaped weave and the stem of each mushroom-shaped interlocking member passing through the weave of the screen material having a length long enough to accommodate the thickness of the screen and a height of the interlocking cap of the opposing attachment pad.

7. The fastening device of claim 6, wherein the spacing of the interlocking members substantially corresponds with the mesh defined by the screen, and the cap of the interlocking members passing through the weave of the screen having a cross-sectional area being less than the area of the shape of the woven mesh so that said cap can pass through a corresponding shape of the woven mesh and interlock with the interlocking members of the opposing attachment pad.

8. A fastening devices comprising;

two opposing attachment pads each pad having two faces with a plurality of mushroom-shaped interlocking members on one face, the interlocking members being uniformly spaced with the interlocking members of the opposing attachment pad;

a screen engaged between the two interlocking attachment pads; and a second material attached to the screen.

9. The fastening device of claim 8, wherein said second material is canvas.

10. The fastening device of claim 8, wherein said second material is plastic.

11. A fastening device, comprising:

two opposing outer attachment pads having a plurality of mushroom-shaped interlocking members on at least one face of each said pad;

an inner attachment pad having at least two faces, each face of said inner attachment pad having a plurality of mushroom-shaped interlocking members; and a screen engaged between one face of the inner attachment pad and one of the outer attachment pads by the mushroom-shaped interlocking members.

12. The fastening device of claim 11, wherein each of said plurality of mushroom-shaped interlocking members comprises a stem having a cap on the distal end of said stem.

13. The fastening device of claim 12, wherein said screen comprises a mesh defining a plurality of openings, wherein the cross sectional area of said openings permits passage of said cap and stem of said interlocking members therethrough so as to securely engage said screen.

14. The fastening device of claim 11, further comprising a second material having a screened-edge, said screened-edge securely engaged between the second face of the inner attachment pad and the opposing outer attachment pad.

15. The fastening device of claim 14, wherein said second material is canvas.

16. The fastening device of claim 14, wherein said second material is plastic.

17. A method for fastening screen material, comprising the steps of:

positioning a first screen between opposing outer attachment pads, said outer attachment pads having a plurality of mushroom-shaped interlocking members arranged in a spaced relationship, each mushroom-shaped interlocking member comprising a stem and a cap, the first screen having a thickness and a mesh comprising a rectangular or square shaped weave, the weave of the screen material corresponding substantially with the spaced relationship of the mushroom-shaped interlocking members of the opposing attachment pads; and applying pressure to the opposing outer attachment pads so as to securely engage the first screen by interlocking the members that pass through the mesh of the screen material and the stem of each mushroom-shaped interlocking member passing through the weave of the screen material having a length long enough to accommodate the thickness of the screen and height of the interlocking cap of the opposing attachment pad.

18. The method of claim 17, wherein the cap of the interlocking members passing through the weave of the screen material having a cross-sectional area being less than the area of each shape of the woven mesh so that said cap can pass through a corresponding shape of the woven mesh and interlock with interlocking members of the opposing attachment pad.

19. A method for fastening screen material, comprising the steps of:

positioning a first screen between opposing outer attachment pads, said outer attachment pads having a plurality of mushroom-shaped interlocking members arranged in a spaced relationship the first screen having a mesh corresponding substantially with the spaced relationship of the mushroom-shaped interlocking members of the opposing attachment pads;

positioning a second material having a screened-edge between the attachment pads simultaneously with the first screen; and applying pressure to the opposing outer attachment pads so as to securely engage the first screen and the second material by interlocking members of the attachment pads.

20. The method of claim 19, further comprising the step of positioning an inner attachment pad and a second screen between the opposing outer attachment pads, wherein positioning of said inner attachment pad and second screen occurs prior to applying pressure to the opposing outer attachment pads, said inner attachment pad having at least two faces, each face of said inner attachment pad having a plurality of mushroom-shaped interlocking members.

* * * * *